US006501253B2

(12) United States Patent
Marty

(10) Patent No.: US 6,501,253 B2
(45) Date of Patent: Dec. 31, 2002

(54) LOW ELECTRICAL CONSUMPTION VOLTAGE REGULATOR

(75) Inventor: Nicolas Marty, Claix (FR)

(73) Assignee: STMicroelectronics S.A., Montrouge (FR)

( * ) Notice: Subject to any disclaimer, the term of this patent is extended or adjusted under 35 U.S.C. 154(b) by 84 days.

(21) Appl. No.: 09/826,299

(22) Filed: Apr. 4, 2001

(65) Prior Publication Data

US 2001/0030530 A1 Oct. 18, 2001

(30) Foreign Application Priority Data

Apr. 12, 2000 (FR) ..... 00 04675

(51) Int. Cl.[7] ..... G05F 1/40
(52) U.S. Cl. ..... 323/280; 323/274; 323/275
(58) Field of Search ..... 323/274, 275, 323/280, 281, 268, 273

(56) References Cited

U.S. PATENT DOCUMENTS 4,319,179 A 3/1982 Jeff, Jr. ..... 323/281
5,355,077 A 10/1994 Kates ..... 323/224
6,046,577 A 4/2000 Rincon-Mora et al. ..... 323/282
6,246,221 B1 * 6/2001 Xi ..... 323/280
6,388,433 B2 * 5/2002 Marty ..... 323/274 X

FOREIGN PATENT DOCUMENTS

EP 0501418 9/1992 ..... G05F/1/59
EP 0678963 10/1995 ..... H02J/7/00

* cited by examiner

*Primary Examiner*—Jessica Han
(74) *Attorney, Agent, or Firm*—Allen, Dyer, Doppelt, Milbrath & Gilchrist, P.A.

(57) ABSTRACT

A voltage regulator includes a regulation MOS transistor and an amplifier providing an output for driving a gate of the regulation MOS transistor. The amplifier drives the gate based upon a difference between a reference voltage and a feedback voltage. The voltage regulator may further include a circuit for making the amplifier switch to a standby mode with low current consumption when the difference between the supply voltage and the output voltage of the regulator is below a first threshold. This is done while maintaining, at the gate of the regulation transistor, a voltage that keeps the regulation transistor on. The present invention is particularly applicable to the management of power supplies in portable telephones.

34 Claims, 4 Drawing Sheets

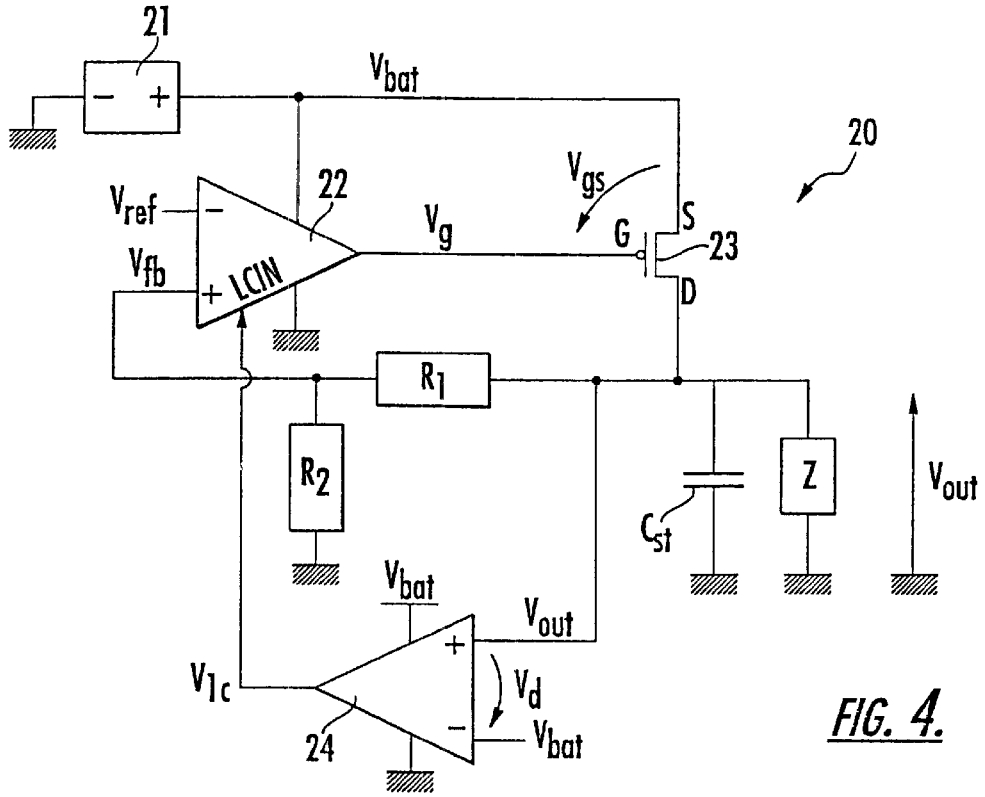
FIG. 4.
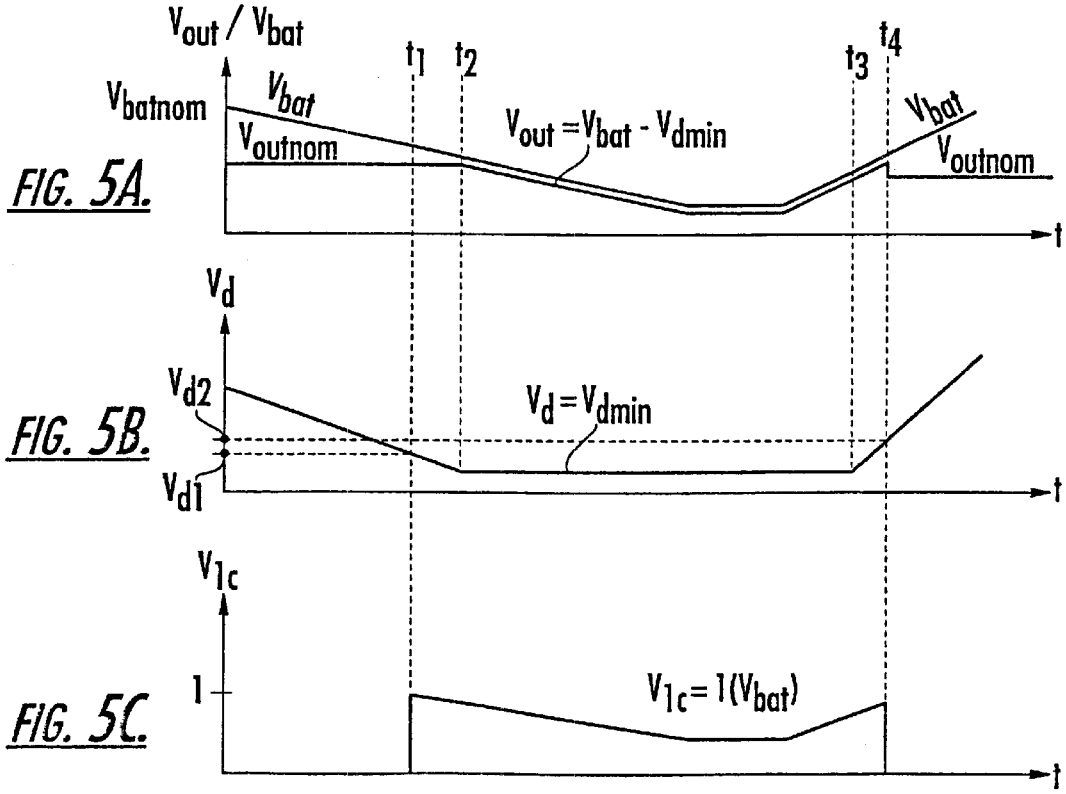
FIG. 5A.
FIG. 5B.
FIG. 5C.

LOW ELECTRICAL CONSUMPTION VOLTAGE REGULATOR

FIELD OF THE INVENTION

The present invention relates to the field of electronic circuits, and, more particularly, to low drop-out (LDO) type linear voltage regulators, namely low serial voltage drop-out regulators.

BACKGROUND OF THE INVENTION

Low drop-out (LDO) linear voltage regulators, such as low serial voltage drop-out regulators, may be used in several applications. In particular, such regulators may be used in mobile telephones to deliver a regulated voltage to radio transmission/reception circuits from a battery.

By way of example, a standard linear regulator 10 according to the prior art whose output delivers a regulated voltage Vout to a load Z is shown in FIG. 1. The load Z represents, for example, several radio circuits in a mobile telephone. The regulator 10 is electrically powered by a voltage Vbat delivered by a battery 1 and includes a differential amplifier 2 whose output drives a gate G of a P-channel metal oxide semiconductor (PMOS) regulation transistor 3. The transistor 3 is generally a transistor with low serial resistance in the conductive or on state (drain-source resistance RdsON), and it receives the voltage Vbat at its source S. A drain D of the transistor 3 is connected to the output of the regulator 10 and to the anode of a capacitor Cst for filtering and stabilizing the voltage Vout. This capacitor Cst is parallel-connected with the load Z.

The amplifier 2 receives a reference voltage Vref at its negative input and a feedback voltage Vfb at its positive output. The voltage Vfb is a fraction of the voltage Vout provided to the input of the amplifier 2 by a divider bridge including two resistors R1, R2.

Operation of a regulator of this kind, which is well known to those skilled in the art, includes modulation of the gate voltage Vg of the transistor 3 using the amplifier 2. This is done based upon a difference between the voltage Vfb and the reference voltage Vref, which the amplifier maintains at about 0 V. When the voltage Vg is smaller than the value Vbat−Vtp, the transistor 3 is on because its gate-source voltage Vgs is higher than the threshold voltage Vtp. When the voltage Vg is higher than Vbat−Vtp, the transistor is off. In a stabilized mode, the voltage Vout is regulated in the neighborhood of its nominal value Voutnom, which is equal to (R1+R2) Vref/R2.

A typical embodiment of the amplifier 2 according to the prior art is shown in FIG. 2. The amplifier 2 includes a differential stage 5 which receives the voltages Vref and Vfb as inputs and is biased by a current generator 6. The output of the differential stage 5 drives the gate of an N-channel MOS (NMOS) transistor 7 connected between the output node of the amplifier 2 and ground. The transistor 7 is biased at its drain D by a current generator 8. The output node of the amplifier is connected to the power supply voltage Vbat by a gate resistor Rg, which determines the gain of the amplifier and the maximum current that can be delivered at the output. Thus, according to the value of the signal delivered by the differential stage 5, the transistor 7 draws the output of the amplifier 2 to ground or the resistor Rg draws the output upwards, namely toward the voltage Vbat.

In an application such as supplying power in a mobile telephone, it is important that the regulation amplifier consume as little electricity as possible to maintain the charge of the battery. To this end, the gate resistance Rg is chosen such that it has a high value (e.g., 100 KΩ) to limit the current flowing in the output stage. At the same time, the currents delivered by the generator 6, 8 are calibrated appropriately. Generally, the choice of the resistance Rg and of the bias currents is the result of a compromise between the need to efficiently drive the transistor 3, which generally has a high parasitic gate capacitance, and the need for low consumption.

Such consumption is typically in the range of 50 to 200 microamperes, i.e., it is acceptable per se when the battery is properly charged, and allows the regulator to work in a stabilized mode. Yet, the present invention is based on the assumption that this consumption is too high when the battery voltages Vbat become low and are below the nominal value Voutnom of the output voltage. Such a drop in the voltage Vbat below the nominal voltage Voutnom may be temporary and due to high current consumption, or it may be due to the fact that the battery has become discharged.

Turning now to FIGS. 3A, 3B, and 3C, according to observations and conclusions that form an integral part of the present invention, the passage of the voltage Vbat below the value Voutnom at an instant tA (FIG. 3A) results in the feedback voltage Vfb being lower than Vref at the input of the amplifier 2. This voltage is unbalanced and makes the gate voltage Vg drop to ground to compensate for the imbalance (FIG. 3B). The regulation transistor 3 is continually on, the voltage Vout becomes substantially equal to the voltage Vbat (FIG. 3), and the regulator 10 works in the follower mode. Since the output node of the amplifier 2 is grounded, it can be seen in FIG. 2 that the consumption in the gate resistor Rg is at the maximum.

Thus, the amplifier consumes current unnecessarily when the regulator works in the follower mode. This is because the regulation transistor is continually on and the output voltage Vout can no longer be regulated.

SUMMARY OF THE INVENTION

An object of the present invention is to provide a voltage regulator which overcomes the above drawback, for example, by switching the regulation amplifier into a low consumption standby mode while keeping the regulation transistor in the on state.

This and other objects, features, and advantages according to the present invention are provided by a, voltage regulator including a regulation MOS transistor and an amplifier whose output drives a gate of the regulation MOS transistor based upon a difference between a reference voltage and a feedback voltage. The voltage regulator may also include a circuit or means to make the amplifier change over into a standby mode with low current consumption when the difference between the supply voltage and the output voltage of the regulator is below a first threshold. This is done while keeping an electrical potential at the gate of the regulation MOS transistor at a value that keeps the regulation MOS transistor in the on state.

More specifically, the voltage regulator may include a comparator for comparing the supply voltage and the output voltage of the regulator and delivering a standby signal to the amplifier when the difference between the supply voltage and the output voltage of the regulator is below the first threshold. Also, the comparator provides a switch-over hysteresis and cancels the signal for putting the amplifier on standby when the difference between the supply voltage and the output voltage of the voltage regulator is higher than a second threshold, where the second threshold is higher than the first threshold.

Additionally, the amplifier may include a resistor connecting the output of the amplifier to the supply voltage. Further, a switch may be series-connected with the resistor and may be open when the amplifier is put on standby. Otherwise, this switch is closed. The amplifier may also include current sources that switch to low current mode when the amplifier is put on standby.

In addition, the amplifier may include a switch driven by a standby-setting signal to connect the gate of the regulation MOS transistor to an electrical potential making the regulation MOS transistor conductive when the amplifier is put on standby. The amplifier may also include a stage for biasing the gate of the regulation MOS transistor when the amplifier is on standby. The stage biases the gate with a voltage that is set so that the gate-source voltage of the regulation MOS transistor is close to the threshold voltage of the regulation MOS transistor. The electrical supply of the amplifier may be eliminated in the standby mode by a switch.

A mobile telephone according to the invention includes at least one radio circuit, a battery, and a voltage regulator as described above for powering the at least one radio circuit from the battery.

A method aspect of the invention is for managing the power available in a battery powering a load using a voltage regulator. The voltage regulator includes a regulation MOS transistor and an amplifier whose output drives a gate of the regulation transistor based upon a difference between the reference voltage and a feedback voltage. The method includes monitoring the difference between the supply voltage and the output voltage of the regulator and switching the amplifier to a standby mode providing low current consumption when the difference between the supply voltage and the output voltage of the regulator is below a first threshold. This is done while keeping the gate of the regulation MOS transistor at a potential that keeps the regulation MOS transistor in the on state.

More specifically, the amplifier may be reactivated when the difference between the supply voltage and the output voltage of the regulator is higher than a second threshold, where the second threshold is higher than the first threshold. The consumption of the amplifier may be reduced in standby mode by disconnecting the output node of the amplifier from the supply voltage, diminishing the current delivered by current sources internal to the amplifier, or disconnecting the supply voltage. Further, when the amplifier is put on standby, it is advantageous to apply a gate voltage to the gate of the regulation MOS transistor where the gate voltage is set so that the gate-source voltage of the regulation transistor is close to its threshold voltage.

BRIEF DESCRIPTION OF THE DRAWINGS

These and other features, characteristics and advantages of the present invention will be explained in greater detail in the following description of an exemplary embodiment of a voltage regulator according to the invention, given by way of non-limitative example, with reference to the appended drawings, in which:

FIG. 4 is a schematic diagram of a voltage regulator according to the invention;

FIGS. 5A to 5C are graphs of electrical signals illustrating operation of the voltage regulator of FIG. 4 in a follower mode.

DETAILED DESCRIPTION OF THE PREFERRED EMBODIMENTS

Figure 1:
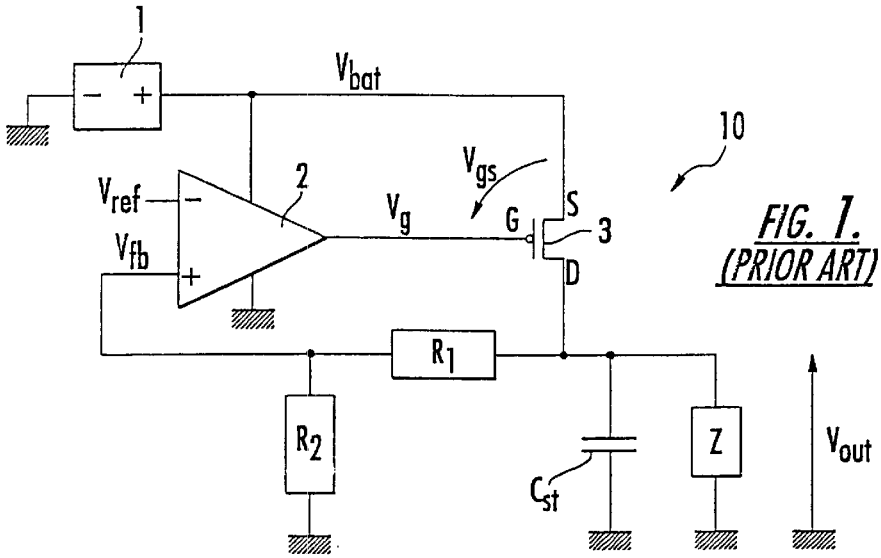
FIG. 1. (PRIOR ART)
FIG. 1 (described above) is a schematic diagram of a voltage regulator according to the prior art.

Turning now to FIG. 4, a regulator 20 according to the invention is supplied with a voltage Vbat provided by a battery 21. The regulator 20, like the regulator described with reference to FIG. 1, includes a differential amplifier 22 whose output controls the gate of a PMOS regulation transistor 23. The drain D of the transistor 23 is connected to the output of the regulator 20 and is connected to a stabilizing capacitor Cst, which is parallel-connected with the load Z. These elements are arranged as described above.

The output voltage Vout is brought to the positive input of the amplifier 2 by a divider bridge including two resistors R1, R2. The resistor R1 may be zero in the case of a direct feedback of the output voltage Vout at the input of the amplifier 22, and the resistor R2 is, in this case, mathematically infinite. The reference voltage Vref applied to the negative input of the amplifier 2 is, for example, a voltage known as a bandgap voltage having high stability as a function of temperature and generated by PN junction diodes and current mirrors. The voltage Vref is thus independent of the voltage Vbat provided that it is smaller than the lowest value of the voltage Vbat.

The working of the regulator 20 in a stabilized operation is as previously described and will therefore not be discussed further herein. The amplifier 2 keeps the feedback voltage Vfb at a level equal to the reference voltage Vref, and the nominal output voltage Voutnom is equal to (R1+R2) Vref/R2.

According to the invention, the amplifier 22 has a "normal" operation mode and a "standby" mode and changes from one to the other according to the value of the signal Vlc applied to an input LCIN, which is designed for this purpose. Placing the amplifier 22 into standby includes placing the amplifier in a state of low electrical consumption while keeping the gate voltage Vg at a potential that keeps the regulation transistor 23 on. Various exemplary embodiments of the amplifier 22 shall be described further below. It will be assumed hereinafter that the amplifier changes over into standby mode when the signal Vlc goes to 1.

The signal Vlc is delivered by a comparator 24 receiving the output voltage Vout at its positive input and the supply voltage Vbat at its negative input, where the comparator 24 is supplied with the voltage Vbat. The comparator 24 is a threshold comparator Vd1 and places its output at 1 (signal Vlc) when the differential voltage Vd at one of its inputs (which is equal to the difference between the voltage Vbat and the voltage Vout) becomes lower than the threshold Vd1. For reasons of output stability, the comparator 24 also preferably has a switch-over hysteresis and resets its output to 0 when the differential voltage Vd rises and becomes greater than a threshold Vd2 greater than Vd1. The thresholds Vd1, Vd2 are equal, for example, to 100 mV and 120 mV respectively.

Thus, as shall be seen in greater detail hereinafter, the amplifier 22 changes into standby mode while keeping the regulation transistor 23 on when the regulator 20 works in follower mode. This is due to a drop in the supply voltage Vbat below the nominal value Voutnom of the output voltage.

Turning to FIGS. 5A, 5B, 5C, the working of the regulator 20 in follower mode and the voltages Vbat and Vout, the differential voltage Vd and the signal Vlc are respectively illustrated. FIGS. 5A and 5B show a reduction of the voltage Vbat from its nominal value Vbatnom, which has no effect on the regulated voltage Vout, which remains equal to Voutnom so long as the voltage Vbat remains greater than Voutnom. The differential voltage Vd diminishes proportionally to the voltage Vbat up to a time t2 when the voltage Vbat becomes substantially equal to Voutnom and drives the voltage Vout, in its drop. The regulator is then unbalanced and working in follower mode.

At the time t2, the differential voltage Vd reaches a minimum value Vdmin that corresponds to the drop in voltage at the terminals of the regulation transistor 23. This drop in voltage Vdmin is very low, e.g., 50 mV, because the regulation transistor of an LDO type regulator generally has a very low drain-source resistance VdsON when it is on. Starting from the time t2, the voltage Vout starts diminishing and follows the voltage Vbat minus the voltage difference Vdmin.

The passage into follower mode is detected by the comparator 24 at a point in time t1 that precedes t2 but is, however, very close to t2 when the differential voltage Vd reaches its threshold Vd1 discussed above, which is chosen to be very close to the minimum Vdmin. Thus, at the time t1, the signal Vlc goes to 1 (FIG. 5C) and the amplifier 2 is put on standby. The "1" logic of the signal Vlc herein is the voltage Vbat which supplies the comparator 24.

FIGS. 5A to 5C show that the voltage Vbat then rises to its nominal value, for example, after the recharging of the battery 21 or the natural regeneration of the battery when the consumed current diminishes. At a time t3, the voltage Vbat exceeds the value Voutnom. At a time t4, the differential voltage Vd crosses the threshold Vd2 and the amplifier 22 changes over into its normal mode of operation. The voltage Vout returns to its nominal value Voutnom.

Figure 6:
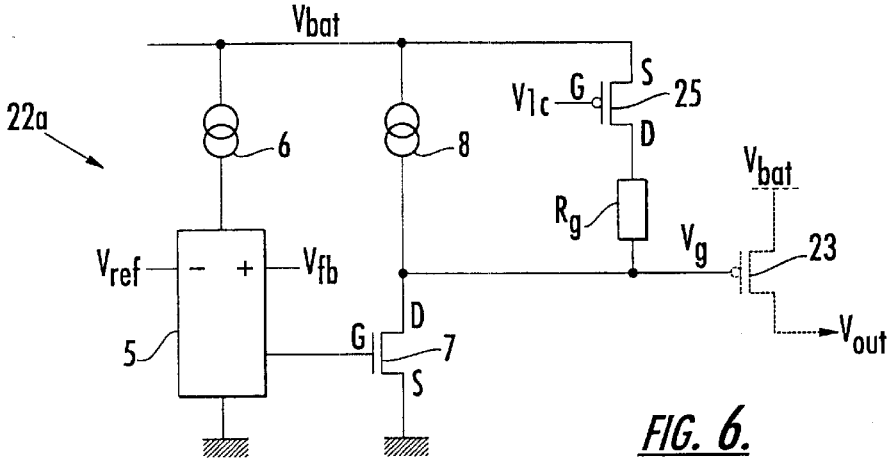
FIGS. 6 to 9 are schematic diagrams of four alternative embodiments of an amplifier of the voltage regulator of FIG. 4.

A non-limiting description will now be given of various embodiments of the amplifier 22 provided by the structure of the amplifier 2 described in the introduction with reference to FIG. 2. The amplifier 22*a* illustrated in FIG. 6 has a structure similar to that of the amplifier 2. The differential stage 5 is biased by the current generator 6 whose output drives the NMOS transistor 7, which is biased at its drain by the current generator 8. A resistor Rg connects the output node of the amplifier 22*a* to the voltage Vbat. A switch 25, e.g., a PMOS transistor, is series-connected with the resistor Rg. The transistor 25 receives the signal Vlc at its gate and is thus permanently on when the regulator works in stabilized operation, the signal Vlc being at 0 as indicated further above.

When the regulator works in follower mode and the voltage Vg at the output node is drawn toward ground by the NMOS transistor 7, the signal Vlc goes to 1, the transistor 25 turns off, and no current flows into the resistor Rg. Cutting off the path connecting the output node of the amplifier 22*a* to the voltage Vbat in this way provides a savings in current consumption that may be substantial, e.g., in the range of 80%.

Figure 7:
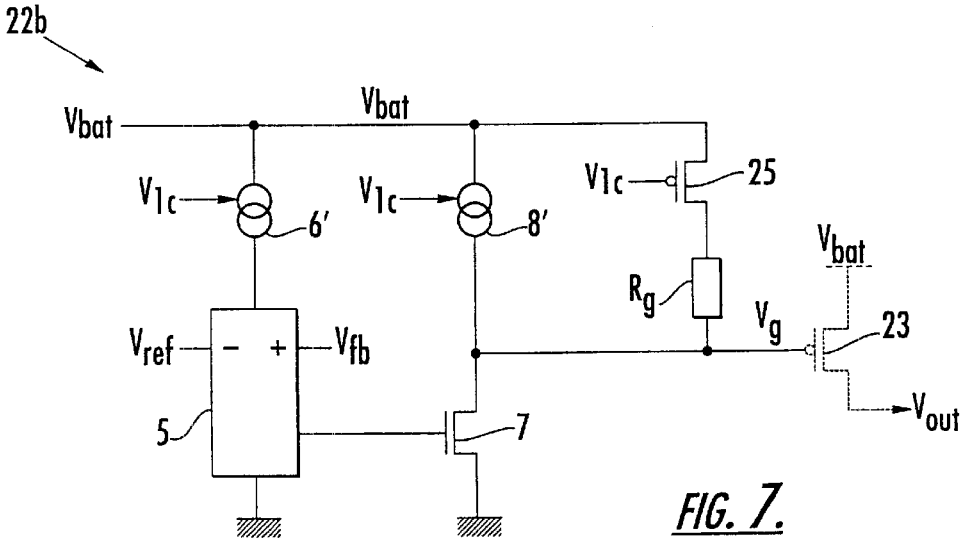

The amplifier 22*b* shown in FIG. 7 differs from the amplifier 22*a* in that the current generators 6, 8 have been replaced by current generators 6', 8' that are controlled by the signal Vlc. The current generators 6', 8' deliver different currents depending on the value Vlc. The respective currents I1', I2' delivered when the signal Vlc is at 1 are, for example, equal to one half of the currents I1, I2 delivered when the signal Vlc is at 0. The currents I1', I2' may be, for example, equal to 10 microamperes and the currents I1, I2 are equal to 20 microamperes. Those skilled in the art will be capable of making such generators 6', 8'. For example, they may be made by the parallel connection in current mirrors of transistors having the same structure and by turning-off of one transistor in two when the signal Vlc is at 1. Thus, this arrangement may save several tens of additional microamperes.

Figure 2:
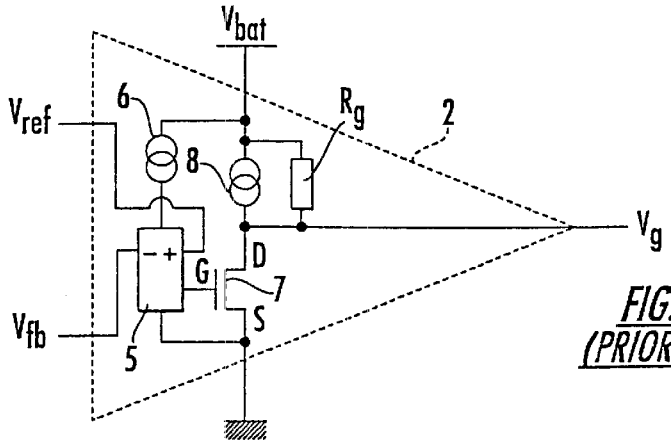
FIG. 2. (PRIOR ART)
FIG. 2 is a more detailed schematic diagram of the amplifier of the voltage regulator of FIG. 1.
Figure 3A:
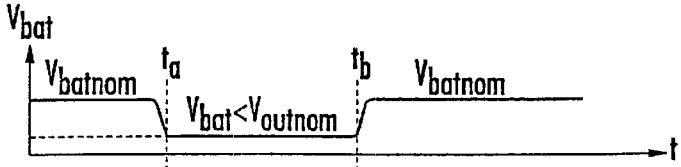
FIG. 3A. (PRIOR ART)
FIGS. 3A to 3C are graphs of electrical signals illustrating operation of the voltage regulator of FIG. 1 when the supply voltage drops below the nominal value of the output voltage.
Figure 3B:
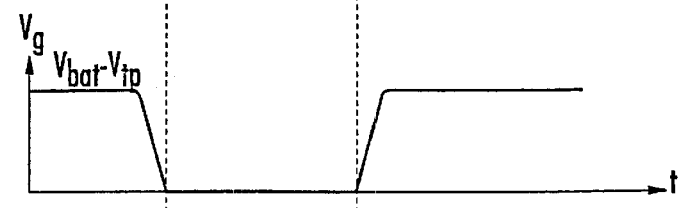
FIG. 3B. (PRIOR ART)
Figure 3C:
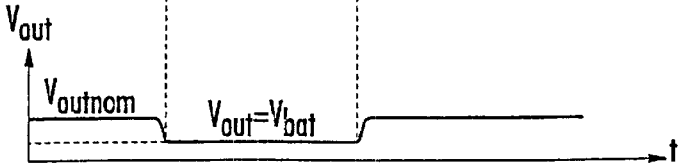
FIG. 3C. (PRIOR ART)
Figure 8:
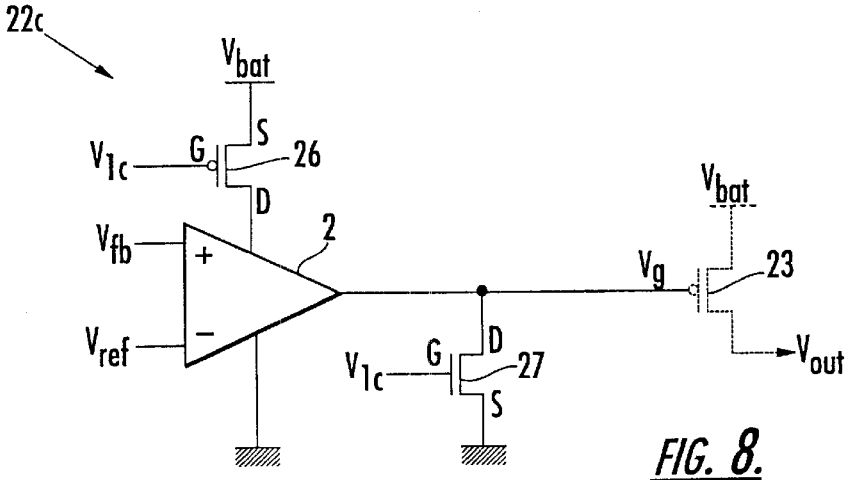

The amplifier 22*c* of FIG. 8 has the same internal structure as the amplifier 2 of FIG. 2. However, the voltage Vbat is applied to the supply input of the amplifier 2 by a PMOS transistor 26 driven by the signal Vlc. Furthermore, an NMOS transistor 27 driven by the signal Vlc is added between the output of the amplifier 2 and ground. Thus, when the signal Vlc is at 0 (balanced regulator), the transistor 26 is on and the transistor 27 is off. The amplifier 2 works as if these two elements did not exist. When the signal Vlc is at 1 (with the regulator in follower mode), the transistor 26 is off and the transistor 27 is on. The amplifier 2 no longer receives the supply voltage Vbat and is completely powered down.

The transistor 27 draws the output of the amplifier to 0 (voltage Vg) to keep the regulation transistor 23 in the on state. This embodiment 22*c* is therefore distinguished from the above embodiments 22*a*, 22*b* in that, in standby mode, the gate voltage Vg is not drawn to ground by the NMOS transistor of the output stage of the amplifier 2, which is out of operation, but rather by the additional transistor 27.

Figure 9:
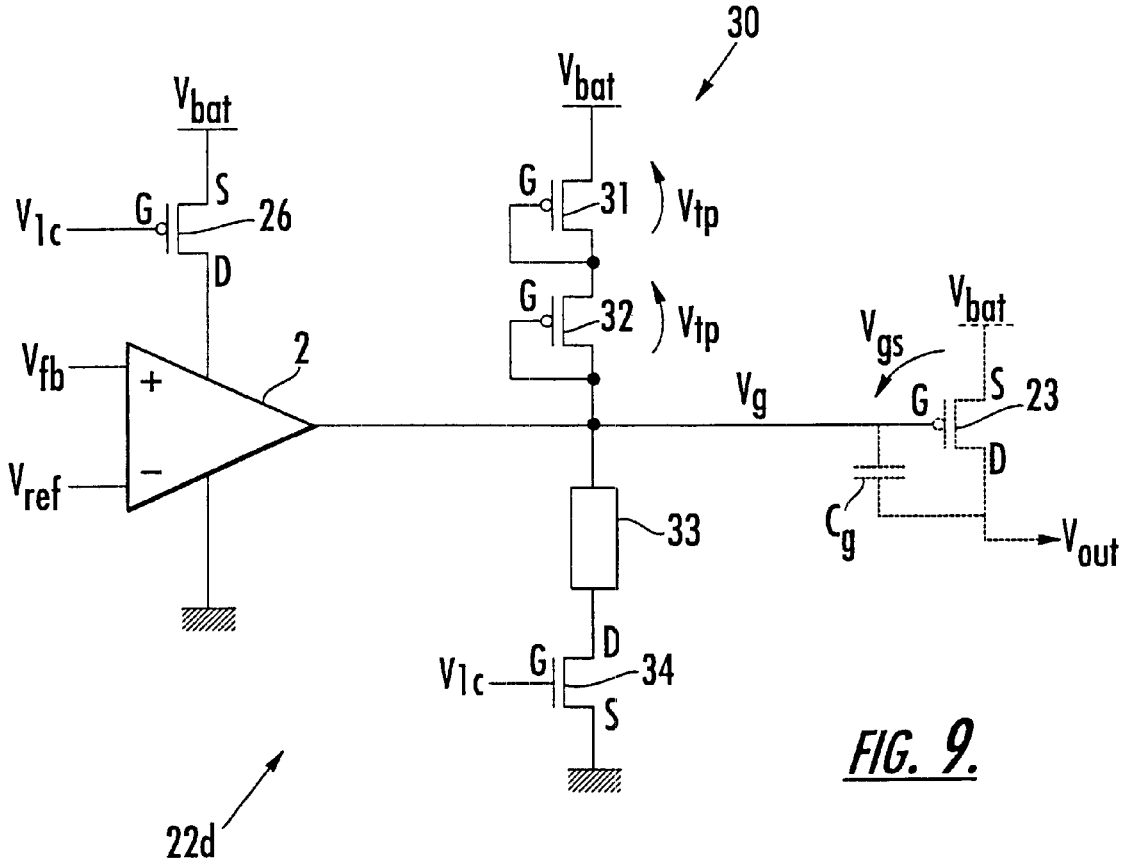

The amplifier 22*d* shown in FIG. 9 also has the amplifier 2 and the transistor 26 for powering-off of the amplifier 2 when the signal Vlc is at 1. The pull-down transistor 27 at the output of the amplifier 22*c* is replaced by a further improved biasing stage 30 that maintains the output of the amplifier 2 at a voltage Vg greater than ground when the amplifier 2 is powered off. The voltage Vg is chosen so that the gate-source voltage Vgs of the regulation transistor 23 is held to about the threshold voltage Vtp of the transistor 23.

The biasing stage 30 has, for example, a first PMOS transistor 31 receiving the voltage Vbat on its source. The first PMOS transistor 31 is connected by its drain to the source of a second PMOS transistor 32, whose drain is connected to the output node of the amplifier 22*d*. The transistors 31, 32 are diode-mounted, each having its gate connected to its drain. Between the output node and ground, the biasing stage 30 includes a high-value resistor 33 series-connected with an NMOS transistor 34 driven by the signal Vlc.

When the regulator works in a stabilized mode, the voltage Vg is held around the value Vbat−Vtp by the output of the amplifier 2, Vtp being the threshold voltage of a PMOS transistor. Thus, the two diode-mounted transistors 31, 32 are turned off. Furthermore, the signal Vlc is at 0 and the transistor 34 is also off. The amplifier 2 works as if the bias stage 30 did not exist. When the regulator is unbalanced, the voltage Vg tends towards 0, the signal Vlc goes to 1, and the amplifier 2 is powered off. The two diode-mounted transistors 31, 32 come on and each of them imposes a voltage Vtp at their terminals so that the gate voltage Vg is equal to Vbat−(2Vtp). The voltage Vgs of the regulation transistor 23 is thus equal to 2Vtp in absolute value and is close to Vtp (plus or minus the value Vtp, in the range of 0.7 V). Of course, other methods may be used to keep the voltage Vg even closer to the threshold voltage Vtp without departing from the scope of the present invention.

An advantage of this embodiment is that it does not entirely discharge the parasitic gate capacitance Cg of the regulation transistor 23 (shown in dashes). A value of the capacitance Cg is generally high (100–200 picofarads) in a regulation transistor with a low serial resistance RdsON. Indeed, when the voltage Vg is grounded, the capacitance Cg is entirely discharged during the standby mode. If the voltage Vbat rises sharply, a delay in the closing of the transistor 23 (turning off the transistor) occurs during the return to regulated mode due to the capacitance Cg charging time. A delay of this kind in closure causes a voltage overshoot at the output of the regulator because the voltage Vout continues to follow the voltage Vbat beyond its nominal value Voutnom. By keeping the voltage Vg non-zero during the standby mode, the gate capacitance Cg does not get entirely discharged, and changing from the standby mode to the regulated mode is done at a high speed with a sharp attenuation of the voltage overshoot phenomenon.

Naturally, various combinations of the characteristics of each of the amplifiers 22*a* to 22*d* may be used to make other alternative embodiments. In particular, the biasing stage 30 of the amplifier 22*d* may be incorporated into the amplifiers 22*a*, 22*b*. It is also within the scope of those skilled in the art to apply the principles and approaches explained herein to known amplifier structures other than that of the amplifier 2, which has been discussed herein as one possible example. Furthermore, although the above examples refer to a regulator having a PMOS type regulation transistor, it is within the scope of the invention and within the scope of those skilled in the art to apply the teachings of the present invention to regulators having an NMOS type regulation transistor.

Furthermore, although the problems resolved by the present invention have been described with reference to mobile or portable telephones, it goes without saying that a regulator according to the invention may be used in various other applications. This is especially true in applications where a supply voltage is provided by a battery whose autonomy needs to be preserved.

That which is claimed is:

1. A voltage regulator comprising:

a regulation MOS transistor having a gate;

an amplifier providing an output for driving the gate of said regulation MOS transistor based upon a difference between a reference voltage and a feedback voltage; and a circuit for causing said amplifier to switch to a standby mode providing reduced current consumption when a difference between a supply voltage and an output voltage of the voltage regulator is below a first threshold while causing said amplifier to provide a voltage at the gate of said regulation MOS transistor for causing said regulation MOS transistor to remain on.

2. The voltage regulator according to claim 1 further comprising a comparator for comparing the supply voltage and the output voltage and providing a standby signal to said amplifier when the difference between the supply voltage and the output voltage is below the first threshold.

3. The voltage regulator according to claim 2 wherein said comparator provides a switch-over hysteresis for disabling the standby signal when the difference between the supply voltage and the output voltage is higher than a second threshold, the second threshold being higher than the first threshold.

4. The voltage regulator according to claim 1 wherein said amplifier comprises a resistor connecting the output of said amplifier to the supply voltage and a switch series-connected with said resistor; and wherein said switch is open when said amplifier is in the standby mode and closed when said amplifier is not in the standby mode.

5. The voltage regulator according to claim 1 wherein said amplifier comprises at least one current source that switches to a low current mode when said amplifier is in the standby mode.

6. The voltage regulator according to claim 1 wherein said amplifier comprises a switch driven by a standby-setting signal for providing the electrical potential at the gate of the regulation MOS transistor to cause the regulation MOS transistor to remain on.

7. The voltage regulator according to claim 1 wherein said amplifier comprises a stage for biasing the gate of said regulation MOS transistor when the amplifier is in the standby mode so that a gate-source voltage of said regulation MOS transistor is substantially equal to a threshold voltage of said regulation MOS transistor.

8. The voltage regulator according to claim 1 wherein said amplifier receives the supply voltage; and further comprising a switch for disconnecting the supply voltage from said amplifier during the standby mode by.

9. A voltage regulator comprising:

a regulation transistor having a control terminal;

an amplifier for driving the control terminal of said regulation transistor; and a circuit for causing said amplifier to switch to a standby mode providing reduced current consumption when a difference between a supply voltage and an output voltage of the voltage regulator is below a first threshold while causing said amplifier to drive the control terminal of said regulation transistor so that the regulation transistor remains on.

10. The voltage regulator according to claim 9 further comprising a comparator for comparing the supply voltage and the output voltage and providing a standby signal to said amplifier when the difference between the supply voltage and the output voltage is below the first threshold.

11. The voltage regulator according to claim 10 wherein said comparator provides a switch-over hysteresis for disabling the standby signal when the difference between the supply voltage and the output voltage is higher than a second threshold, the second threshold being higher than the first threshold.

12. The voltage regulator according to claim 9 wherein said amplifier comprises a resistor connecting the output of said amplifier to the supply voltage and a switch series-connected with said resistor; and wherein said switch is open when said amplifier is in the standby mode and closed when said amplifier is not in the standby mode.

13. The voltage regulator according to claim 9 wherein said amplifier comprises at least one current source that switches to a low current mode when said amplifier is in the standby mode.

14. The voltage regulator according to claim 9 wherein said amplifier comprises a switch driven by a standby-setting signal for driving the control terminal of said regulation transistor to cause the regulation transistor to remain on.

15. The voltage regulator according to claim 9 wherein said amplifier comprises a stage for biasing the control terminal of said regulation transistor when said amplifier is in the standby mode so that a gate-source voltage of said regulation transistor is substantially equal to a threshold voltage of said regulation transistor.

16. The voltage regulator according to claim 9 wherein said amplifier receives the supply voltage; and further comprising a switch for disconnecting the supply voltage from said amplifier during the standby mode.

17. A mobile telephone comprising:

at least one circuit for sending and receiving communications signals;

a battery for providing power to said at least one circuit; and a voltage regulator for regulating the power supplied by said battery to said at least one circuit, said voltage regulator comprising a regulation transistor having a control terminal, an amplifier for driving the control terminal of said regulation transistor, and a circuit for causing said amplifier to switch to a standby mode providing reduced current consumption when a difference between a supply voltage and an output voltage of said voltage regulator is below a first threshold while causing said amplifier to drive the control terminal of said regulation transistor so that the regulation transistor remains on.

18. The mobile telephone according to claim 17 wherein said voltage regulator further comprises a comparator for comparing the supply voltage and the output voltage and providing a standby signal to said amplifier when the difference between the supply voltage and the output voltage is below the first threshold.

19. The mobile telephone according to claim 18 wherein said comparator provides a switch-over hysteresis for disabling the standby signal when the difference between the supply voltage and the output voltage is higher than a second threshold, the second threshold being higher than the first threshold.

20. The mobile telephone according to claim 17 wherein said amplifier comprises a resistor connecting the output of said amplifier to the supply voltage and a switch series-connected with said resistor; and wherein said switch is open when said amplifier is in the standby mode and closed when said amplifier is not in the standby mode.

21. The mobile telephone according to claim 17 wherein said amplifier comprises at least one current source that switches to a low current mode when said amplifier is in the standby mode.

22. The mobile telephone according to claim 17 wherein said amplifier comprises a switch driven by a standby-setting signal for driving the control terminal of said regulation transistor to cause said regulation transistor to remain on.

23. The mobile telephone according to claim 17 wherein said amplifier comprises a stage for biasing the control terminal of said regulation transistor when said amplifier is in the standby mode so that a gate-source voltage of said regulation transistor is substantially equal to a threshold voltage of said regulation transistor.

24. The mobile telephone according to claim 17 wherein said amplifier receives the supply voltage; and further comprising a switch for disconnecting the supply voltage from said amplifier during the standby mode.

25. A method for managing power from a battery supplying a load using a voltage regulator, the voltage regulator comprising a regulation MOS transistor and an amplifier providing an output voltage for driving a gate of the regulation MOS transistor based upon a difference between a reference voltage and a feedback voltage, the method comprising:

monitoring a difference between a supply voltage and the output voltage; and switching the amplifier to a standby mode providing reduced current consumption when the difference between the supply voltage and an output voltage of the voltage regulator is below a first threshold while causing the amplifier to provide a voltage at the gate of the regulation MOS transistor for causing the regulation MOS transistor to remain on.

26. The method according to claim 25 further comprising activating the amplifier when the difference between the supply voltage and the output voltage is higher than a second threshold, the second threshold being higher than the first threshold.

27. The method according to claim 25 wherein the current consumption of the amplifier in the standby mode is reduced by disconnecting an output node of the amplifier from the supply voltage.

28. The method according to claim 25 wherein the amplifier comprises at least one current source; and wherein the current consumption of the amplifier in standby mode is reduced by diminishing a current provided by the at least one current source.

29. The method according to claim 25 wherein the amplifier receives the supply voltage; and further comprising disconnecting the supply voltage from the amplifier during the standby mode.

30. The method according to claim 25 further comprising providing a voltage to the gate of the regulation MOS transistor for causing a gate-source voltage of the regulation MOS transistor to be substantially equal to a threshold voltage of the regulation MOS transistor when the amplifier is in the standby mode.

31. A method for using a voltage regulator comprising a regulation transistor having a control terminal and an amplifier for driving the control terminal of the regulation transistor, the method comprising:

switching the amplifier to a standby mode providing reduced current consumption when a difference between a supply voltage and an output voltage of the regulation transistor is below a first threshold; and driving the control terminal of the regulation transistor with the amplifier during switching so that the regulation transistor remains on.

32. The method according to claim 31 further comprising comparing the supply voltage and the output voltage and providing a standby signal to the amplifier when the difference between the supply voltage and the output voltage is below the first threshold.

33. The method according to claim 32 further comprising disabling the standby signal when the difference between the supply voltage and the output voltage is higher than a second threshold, the second threshold being higher than the first threshold and defining a switch-over hysteresis therewith.

34. The method according to claim 31 wherein the amplifier comprises a resistor connecting the output of the amplifier to the supply voltage and a switch series-connected with the resistor; and further comprising opening the switch when the amplifier is in the standby mode and closing the switch when the amplifier is not in the standby mode.

* * * * *